United States Patent [19]

Waynick

[11] Patent Number: 4,830,767

[45] **Date of Patent: * May 16, 1989**

[54] FRONT-WHEEL DRIVE GREASE

[75] Inventor: John A. Waynick, Bolingbrook, Ill.

[73] Assignee: Amoco Corporation, Chicago, Ill.

[ * ] Notice: The portion of the term of this patent subsequent to Nov. 29, 2005 has been disclaimed.

[21] Appl. No.: 77,607

[22] Filed: Jul. 24, 1987

Related U.S. Application Data

[63] Continuation-in-part of Ser. No. 830,710, Feb. 18, 1986.

[51] Int. Cl.[4] ..... C10M 117/00; C10M 125/10; C10M 125/24

[52] U.S. Cl. ..... 252/25; 252/51.5 R; 252/49.6; 252/52 R

[58] Field of Search ..... 252/18, 51.5, 25, 32.5

[56] References Cited

U.S. PATENT DOCUMENTS

| | | | |
|---|---|---|---|
| 4,107,058 | 8/1978 | Clarke et al. | 252/18 |
| 4,305,831 | 12/1981 | Johnson III et al. | 252/18 |
| 4,440,658 | 4/1984 | Piotrowski et al. | 252/51.5 |

*Primary Examiner*—Ferris H. Lander

*Attorney, Agent, or Firm*—Thomas W. Tolpin; William H. Magidson; Ralph C. Medhurst

[57] ABSTRACT

A high performance lubricating grease effectively lubricates and greases front-wheel drive joints. The front-wheel drive grease has excellent extreme pressure properties and antiwear qualities and is economical, nontoxic and safe. In the pereferred form, the front-wheel drive grease comprises a base oil, a polyurea thickener, and an additive package comprising tricalcium phosphate and calcium carbonate.

6 Claims, No Drawings

FRONT-WHEEL DRIVE GREASE

CROSS REFERENCE TO RELATED APPLICATION

This patent application is a continuation-in-part of the patent application of John Andrew Waynick, Ser. No. 830,710, filed Feb. 18, 1986 entitled, Front-Wheel Drive Grease, before Examiner F. H. Lander, in Group Art Unit 118 and now abandoned.

BACKGROUND OF THE INVENTION

This invention pertains to lubricants and, more particularly, to a lubricating grease which is particularly useful for drive joints of front-wheel drive vehicles.

In front-wheel drive automobiles, vans, and trucks, the front wheels are driven by the engine via a front axle assembly and a number of front-wheel drive joints. These front-wheel drive joints facilitate movement of the front axle assembly while maintaining constant rotational velocity between the front wheels. The front-wheel drive joint is often referred to as a constant velocity (CV) joint. The outer CV joints usually have a protective boot comprising an elastomer, such as polyester or neoprene, and the inner joints usually have a protective boot comprising a higher temperature-resistant elastomer, such as silicon-based elastomers.

Front-wheel drive joints experience extreme pressures, torques, and loads during use. Operating temperatures can vary from −40° F. during winter to over 300° F. during summer.

Front-wheel drive greases are required to provide wear resistance. When a front-wheel drive vehicle is driven, sliding, rotational, and oscillatory (fretting) motions simultaneously occur within the front wheel drive joint, along with large loads and torques. A grease which minimizes wear from one of these motions or conditions will not necessarily protect against the others.

Front-wheel drive greases are also required to be chemically compatible with the elastomers and seals in front-wheel drive joints. Such greases should not chemically corrode, deform, or degrade the elastomers and seals which could cause swelling, hardening, loss of tensile strength, and ultimately rupture, oil leakage, and mechanical failure of the CV joints and seals.

Over the years, a variety of greases have been suggested for use with front-wheel drive joints and/or other mechanisms. Typifying such greases are those found in U.S. Pat. Nos. 2,964,475, 2,967,151, 3,344,065, 3,843,528, 3,846,314, 3,920,571, 4,107,058, 4,305,831, 4,431,552, 4,440,658, 4,514,312, and Re. 31,611. These greases have met with varying degrees of success.

It is, therefore, desirable to provide an improved front-wheel drive grease which overcomes most, if not all, of the above problems.

SUMMARY OF THE INVENTION

An improved lubricating grease is provided which is particularly useful for front-wheel drive joints. The novel grease displayed unexpectedly surprisingly good results over prior art greases. The new grease provides superior wear protection from sliding, rotational, and oscillatory (fretting) motions in front-wheel drive joints. It is also chemically compatible with elastomers and seals in front-wheel drive joints. It further resists chemical corrosion, deformation, and degradation of the elastomers and extends the useful life of CV (constant velocity) drive joints.

The novel grease performs well at high temperatures and over long periods of time. It exhibits excellent stability, superior fretting wear qualities, and good oil separation properties even at high temperatures. Advantageously, the grease is economical to manufacture and can be produced in large quantities.

To this end, the improved lubricating grease has: (a) a substantial proportion of a base oil, (b) a thickener, such as polyurea, triurea, or biurea, and (c) a sufficient amount of an additive package to impart extreme pressure properties to the grease.

In one form, the additive package comprises tricalcium phosphate in the absence of oil soluble sulfur compounds. Tricalcium phosphate provides many unexpected surprisingly good advantages over monocalcium phosphate and dicalcium phosphate. For example, tricalcium phosphate is water insoluble and will not be extracted from the grease if contacted with water. Tricalcium phosphate is also very compatible with the elastomers and seals in front-wheel drive joints.

On the other hand, monocalcium phosphate and dicalcium phosphate are water soluble. When water comes into significant contact with monocalcium or dicalcium phosphate, they have a tendency to leach, run, extract, and washout of the grease. This destroys any significant antiwear and extreme pressure qualities of the grease. Monocalcium phosphate and dicalcium phosphate are also protonated and have acidic hydrogen present which can adversely react, crack, degrade, and corrode seals and elastomers.

In another form, the additive package comprises carbonates and phosphates together in the absence of oil soluble sulfur compounds and insoluble arylene sulfide polymers. The carbonates and phosphates are of a Group 2a alkaline earth metal, such as beryllium, manganese, calcium, strontium, and barium, or of a Group 1a alkali metal, such as lithium, sodium, potassium, rubidium, cesium, and francium. Calcium carbonate and tricalcium phosphate are preferred for best results because they are economical, stable, nontoxic, water insoluble, and safe.

The use of both carbonates and phosphates in the additive package produced unexpected surprisingly good results over the use of greater amounts of either carbonates alone or phosphates alone. For example, the use of both carbonates and phosphates produced superior wear protection in comparison to a similar grease with a greater amount of carbonates in the absence of phosphates, or a similar grease with a greater amount of phosphates in the absence of carbonates. Furthermore, the synergistic combination of calcium carbonate and tricalcium phosphate can reduce the total additive level over a single additive and still maintain superior performance over a single additive.

Furthermore, the combination of the above carbonates and phosphates in the absence of insoluble arylene sulfide polymers achieved unexpected surprisingly good results over that combination with insoluble arylene sulfide polymers. It was found that applicant's combination attained superior extreme pressure properties and antiwear qualities as well as superior elastomer compatibility, while the addition of insoluble arylene sulfide polymers caused abrasion, corroded copper, degraded elastomers and seals, and significantly weakened their tensile strength and elastomeric qualities.

Insoluble arylene sulfide polymers are also very expensive, making their use in lubricants prohibitively costly.

The use of oil soluble sulfur containing compounds should generally be avoided in the additive package of front-wheel drive greases because they are chemically incompatible and detrimental to constant velocity joint boot elastomers and seals of the type used in front-wheel drive vehicles. Oil soluble sulfur compounds often destroy, degrade, or otherwise damage constant velocity joint boot elastomers and seals by adversely affecting their tensile strength and elasticity.

While the novel lubricating grease is particularly useful for front-wheel drive joints, it can also be advantageously used in universal joints and in bearings which are subjected to heavy shock loads, fretting, and oscillating motions. It can also be used as a railroad track lubricant on the sides of a railroad track.

A more detailed explanation of the invention is provided in the following description and appended claims.

DETAILED DESCRIPTION OF THE PREFERRED EMBODIMENT

A high performance lubricating grease is provided to effectively lubricate and grease a front-wheel drive joint. The novel front-wheel drive grease exhibits excellent extreme pressure (EP) properties and antiwear qualities and is economical, nontoxic, and safe.

The front-wheel drive grease is chemically compatible and substantially inert to the elastomers and seals of front-wheel drive joints and provides a protective lubricating coating for the drive joints. It will not significantly corrode, deform, or degrade silicon-based elastomers of the type used in the inner front-wheel drive joints, even at high temperatures experienced in prolonged desert driving. Nor will it significantly corrode, deform, or degrade front-wheel drive silicone-based seals with minimal overbasing from calcium oxide or calcium hydroxide. It further will not corrode, deform, or degrade polyester and neoprene elastomers of the type used in the boots of the outer front-wheel drive joints and substantially helps prevent the elastomers from cracking and becoming brittle during prolonged winter driving. It is also chemically inert to steel and copper corrosion even at the high temperatures which can be encountered in front-wheel drive joints.

The grease is an excellent lubricant between contacting metals and/or elastomeric plastics. It provides superior protection against fretting wear caused by repetitive oscillating and jostling motions of short amplitude, such as experienced by new cars during shipment by truck or railroad. It also provides outstanding protection against dynamic wear caused by sliding, rotational and oscillating motions of large amplitudes, of the type experienced in rigorous prolonged highway and mountain driving. It further accommodates rapid torque and loading increases during acceleration and sudden heavy shock loads when a front-wheel drive vehicle rides over fields, gravel roads, potholes, and bumps.

The preferred lubricating grease comprises by weight: 45% to 85% base oil, 3% to 15% polyurea thickener, and 4% to 40% extreme pressure wear-resistant additives. For best results, the front-wheel drive lubricating grease comprises by weight: at least 70% base oil, 7% to 12% polyurea thickener, and 6% to 20% extreme pressure wear resistant additives.

Insoluble arylene sulfide polymers and other oil insoluble sulfur compounds should be avoided in the grease because they: (1) corrode copper and other metals, (2) degrade, deform, and corrode silicon seals, (3) significantly diminish the tensile strength and elastomeric properties of many elastomers, (4) exhibit inferior fretting wear, and (5) are abrasive.

Oil soluble sulfur compounds can be even more aggravating, troublesome, and worse than oil insoluble sulfur compounds. Oil soluble sulfur compounds should be generally avoided in the grease because they are often chemically incompatible and detrimental to silicone, polyester, and other types of constant velocity joint boot elastomers and seals of the type used in front-wheel drive vehicles. Oil soluble sulfur compounds can destroy, degrade, deform, chemically corrode, or otherwise damage constant velocity joint boot elastomers and seals by significantly diminishing their tensile strength and elasticity.

Generally, any oil soluble sulfur containing compound should be avoided in the additive composition of the front-wheel drive grease, especially the sulfurized hydrocarbons and organometallic sulfur salts. Sulfur compounds of the type to be avoided include saturated and unsaturated aliphatic as well as aromatic derivatives that have from 1 to 32 or 1 to 22 carbon atoms. Included in this group of oil soluble sulfur compounds to be avoided are alkyl sulfides and alkyl polysulfides, aromatic sulfides and aromatic polysulfides, e.g. benzyl sulfide and dibenzyl disulfide, organometallic salts of various sulfur containing acids such as the metal neutralized salts of dialkyl dithiophosphoric acid, e.g. zinc dialkyl dithiophosphate as well as phosphosulfurized hydrocarbons and sulfurized oils and fats. Sulfurized and phosphosulfurized products of various polyolefins are particularly detrimental. One particularly detrimental group of sulfurized olefins or polyolefins are those prepared from aliphatic or terpenic olefins having a total of 10 to 32 carbon atoms in the molecule and such materials are generally sulfurized such that they contain from about 10 to about 60 weight percent sulfur. The aliphatic olefins to be avoided include mixed olefins such as cracked wax, cracked petrolatum or single olefins such as tridecene-2, octadecene-1, eikosene-1 as well as polymers of aliphatic olefins having from 2 to 5 carbon atoms per monomer such as ethylene, propylene, butylene, isobutylene and pentene. The terpenic olefins to be avoided include terpenes ($C_{10}H_{16}$), sesquiterpense ($C_{15}H_{24}$) and diterpense ($C_{20}H_{32}$). Of the terpenses, the monocyclic terpenes having the general formula $C_{10}H_{16}$ and its monocyclic isomers are particularly detrimental.

Inhibitors

The additive package may be complemented by the addition of small amounts of an antioxidant and a corrosion inhibiting agent, as well as dyes and pigments to impart a desired color to the composition.

Antioxidants or oxidation inhibitors prevent varnish and sludge formation and oxidation of metal parts. Typical antioxidants are organic compounds containing nitrogen, such as organic amines, sulfides, hydroxy sulfides, phenols, etc., alone or in combination with metals like zinc, tin, or barium, as well as phenyl-alpha-naphthyl amine, bis(alkylphenyl)amine, N,N -diphenyl-p-phenylenediamine, 2,2,4 - trimethyldihydroquinoline oligomer, bis(4 - isopropylaminophenyl)-ether, N-acyl-p-aminophenol, N - acylphenothiazines, N - hydrocarbyl-amides of ethylenediamine tetraacetic acid, and alkylphenol-formaldehyde-amine polycondensates.

Corrosion inhibiting agents or anticorrodants prevent rusting of iron by water, suppress attack by acidic bodies, and form protective film over metal surfaces to diminish corrosion of exposed metallic parts. A typical corrosion inhibiting agent is an alkali metal nitrite, such as sodium nitrate. Other ferrous corrosion inhibitors include metal sulfonate salts, alkyl and aryl succinic acids, and alkyl and aryl succinate esters, amides, and other related derivatives. Borated esters, amines, ethers, and alcohols can also be used with varying success to limit ferrous corrosion.

Metal deactivators can also be added to prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines.

Stabilizers, tackiness agents, dropping-point improvers, lubricating agents, color correctors, and/or odor control agents can also be added to the additive package.

Base Oil

The base oil can be naphthenic oil, paraffinic oil, aromatic oil, or a synthetic oil such as a polyalphaolefin (PAO), polyester, diester, polyalkyl ethers, polyaryl ethers, silicone polymer fluids, or combinations thereof. The viscosity of the base oil can range from 50 to 10,000 SUS at 100° F.

Other hydrocarbon oils can also be used, such as: (a) oil derived from coal products, (b) alkylene polymers, such as polymers of propylene, butylene, etc., (c) alkylene oxide-type polymers, such as alkylene oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol2-pentoxy) disilicone, poly(methyl)siloxane, and poly(methyl)phenylsiloxane.

The preferred base oil comprises about 60% by weight of a refined solvent-extracted hydrogenated dewaxed base oil, preferably 850 SUS oil, and about 40% by weight of another refined solvent-extracted hydrogenated dewaxed base oil, preferably 350 SUS oil, for better results.

Thickener

Polyurea thickeners are preferred over other types of thickeners because they have high dropping points, typically 460° F. to 500° F., or higher. Polyurea thickeners are also advantageous because they have inherent antioxidant characteristics, work well with other antioxidants, and are compatible with all the elastomers and seals of front-wheel drive joints.

The polyurea comprising the thickener can be prepared in a pot, kettle, bin, or other vessel by reacting an amine, such as a fatty amine, with diisocyanate, or a polymerized diisocyanate, and water. Other amines can also be used.

EXAMPLE 1

Polyurea thickener was prepared in a pot by adding: (a) about 30% by weight of a solvent extracted neutral base oil containing less than 0.1% by weight sulfur with a viscosity of 600 SUS at 100° F. and (b) about 7.45% by weight of primary oleyl amine. The primary amine base oil was then mixed for 30–60 minutes at a maximum temperature of 120° F. with about 5.4% by weight of an isocyanate, such as 143 L-MDI manufactured by Upjohn Company. About 3% by weight water was then added and stirred for about 20 to 30 minutes, before removing excess free isocyanates and amines.

The polyurea thickener can also be prepared, if desired, by reacting an amine and a diamine with diisocyanate in the absence of water. For example, polyurea can be prepared by reacting the following components:

1. A diisocyanate or mixture of diisocyanates having the formula OCN—R—NCO, wherein R is a hydrocarbylene having from 2 to 30 carbons, preferably from 6 to 15 carbons, and most preferably 7 carbons;
2. A polyamine or mixture of polyamines having a total of 2 to 40 carbons and having the formula:

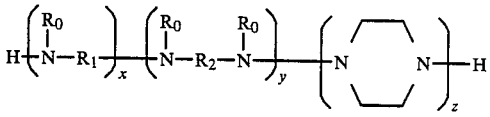

wherein $R_1$ and $R_2$ are the same or different types of hydrocarbylenes having from 1 to 30 carbons, and preferably from 2 to 10 carbons, and most preferably from 2 to 4 carbons; $R_0$ is selected from hydrogen or a C1–C4 alkyl, and preferably hydrogen; x is an integer from 0 to 4; y is 0 or 1; and z is an integer equal to 0 when y is 1 and equal to 1 when y is 0.

3. A monofunctional component selected from the group consisting of monoisocyanate or a mixture of monoisocyanates having 1 to 30 carbons, preferably from 10 to 24 carbons, a monoamine or mixture of monoamines having from 1 to 30 carbons, preferably from 10 to 24 carbons, and mixtures thereof.

The reaction can be conducted by contacting the three reactants in a suitable reaction vessel at a temperature between about 60° F. to 320° F., preferably from 100° F. to 300° F., for a period of 0.5 to 5 hours and preferably from 1 to 3 hours. The molar ratio of the reactants present can vary from 0.1–2 molar parts of monoamine or monoisocyanate and 0–2 molar parts of polyamine for each molar part of diisocyanate. When the monoamine is employed, the molar quantities can be (m+1) molar parts of diisocyanate, (m) molar parts of polyamine and 2 molar parts of monoamine. When the monoisocyanate is employed, the molar quantities can be (m) molar parts of diisocyanate, (m+1) molar parts of polyamine and 2 molar parts of monoisocyanate (m is a number from 0.1 to 10,preferably 0.2 to 3, and most preferably 1).

Mono- or polyurea compounds can have structures defined by the following general formula:

$$R_3-NH\left(\overset{O}{\overset{\|}{C}}-NH-R_4-NH-\overset{O}{\overset{\|}{C}}-NH-R_5-NH\right)_n\overset{O}{\overset{\|}{C}}-NH-R_4-NH-\overset{O}{\overset{\|}{C}}-NH-R_3 \quad (1)$$

$$R_3NH-\overset{O}{\overset{\|}{C}}-NH-R_5NH\left(\overset{O}{\overset{\|}{C}}-NH-R_4-NH-\overset{O}{\overset{\|}{C}}-NH-R_5-NH\right)_n\overset{O}{\overset{\|}{C}}-NH-R_3 \quad (2)$$

$$R_3-NH\left(\overset{O}{\overset{\|}{C}}-NH-R_4-NH-\overset{O}{\overset{\|}{C}}-NH-R_5-NH\right)_n\overset{O}{\overset{\|}{C}}-NH-R_3 \quad (3)$$

wherein n is an integer from 0 to 3; $R_3$ is the same or different hydrocarbyl having from 1 to 30 carbon atoms, preferably from 10 to 24 carbons; $R_4$ is the same or different hydrocarbylene having from 2 to 30 carbon atoms, preferably from 6 to 15 carbons; and $R_5$ is the same or different hydrocarbylene having from 1 to 30 carbon atoms, preferably from 2 to 10 carbons.

As referred to herein, the hydrocarbyl group is a monovalent organic radical composed essentially of hydrogen and carbon and may be aliphatic, aromatic, alicyclic, or combinations thereof, e.g., aralkyl, alkyl, aryl, cycloalkyl, alkylcycloalkyl, etc., and may be saturated or olefinically unsaturated (one or more double-bonded carbons, conjugated, or nonconjugated). The hydrocarbylene, as defined in $R_1$ and $R_2$ above, is a divalent hydrocarbon radical which may be aliphatic, alicyclic, aromatic, or combinations thereof, e.g., alkylaryl, aralkyl, alkylcycloalkyl, cycloalkylaryl, etc., having its two free valences on different carbon atoms.

The mono- or polyureas having the structure presented in Formula 1 above are prepared by reacting (n+1) molar parts of diisocyanate with 2 molar parts of a monoamine and (n) molar parts of a diamine. (When n equals zero in the above Formula 1, the diamine is deleted). Mono- or polyureas having the structure presented in Formula 2 above are prepared by reacting (n) molar parts of a diisocyanate with (n+1) molar parts of a diamine and 2 molar parts of a monoisocyanate. (When n equals zero in the above Formula 2, the diisocyanate is deleted). Mono- or polyureas having the structure presented in Formula 3 above are prepared by reacting (n) molar parts of a diisocyanate with (n) molar parts of a diamine and 1 molar part of a monoisocyanate and 1 molar part of a monoamine. (When n equals zero in Formula 3, both the diisocyanate and diamine are deleted).

In preparing the above mono- or polyureas, the desired reactants (diisocyanate, monoisocyanate, diamine, and monoamine) are mixed in a vessel as appropriate. The reaction may proceed without the presence of a catalyst and is initiated by merely contacting the component reactants under conditions conducive for the reaction. Typical reaction temperatures range from 70° F. to 210° F. at atmospheric pressure. The reaction itself is exothermic and, by initiating the reaction at room temperature, elevated temperatures are obtained. External heating or cooling may be used.

The monoamine or monoisocyanate used in the formulation of the mono- or polyurea can form terminal end groups. These terminal end groups can have from 1 to 30 carbon atoms, but are preferably from 5 to 28 carbon atoms, and more desirably from 10 to 24 carbon atoms. Illustrative of various monoamines are: pentylamine, hexylamine, heptylamine, octylamine, decylamine, dodecylamine, tetradecylamine, hexadecylamine, octadecylamine, eicosylamine, dodecenylamine, hexadecenylamine, octadecenylamine, octadeccadienylamine, abietylamine, aniline, toluidine, naphthylamine, cumylamine, bornylamine, fenchylamine, tertiary butyl aniline, benzylamine, beta-phenethylamine, etc. Preferred amines are prepared from natural fats and oils or fatty acids obtained therefrom. These starting materials can be reacted with ammonia to give first amides and then nitriles. The nitriles are reduced to amines by catalytic hydrogenation. Exemplary amines prepared by the method include: stearylamine, laurylamine, palmitylamine, oleylamine, petroselinylamine, linoleylamine, linolenylamine, eleostearylamine, etc. Unsaturated amines are particularly useful. Illustrative of monoisocyanates are: hexylisocyanate, decylisocyanate, dodecylisocyante, tetradecylisocyanate, hexadecylisocyanate, phenylisocyanate, cyclohexylisocyanate, xyleneisocyanate, cumeneisocyanate, abietylisocyanate, cyclooctylisocyanate, etc.

Polyamines which form the internal hydrocarbon bridges can contain from 2 to 40 carbons and preferably from 2 to 30 carbon atoms, more preferably from 2 to 20 carbon atoms. The polyamine preferably has from 2 to 6 amine nitrogens, preferably 2 to 4 amine nitrogens and most preferably 2 amine nitrogens. Such polyamines include: diamines such as ethylenediamine, propanediamine, butanediamine, hexanediamine, dodecanediamine, octanediamine, hexadecanediamine, cyclohexanediamine, cyclooctanediamine, phenylenediamine, tolylenediamine, xylylenediamine, dianiline methane, ditoluidinemethane, bis(aniline), bis(toluidine), piperazine, etc.; triamines, such as aminoethyl piperazine, diethylene triamine, dipropylene triamine, N-methyldiethylene triamine, etc., and higher polyamines such as triethylene tetraamine, tetraethylene pentaamine, pentaethylene hexamine, etc.

Representative examples of diisocyanates include: hexane diisocyanate, decanediisocyanate, octadecanediisocyanate, phenylenediisocyanate, tolylenediisocyanate, bis(diphenylisocyanate), methylene bis(phenylisocyanate), etc.

Other mono- or polyurea compounds which can be used are:

$$X\left(R_4-NH-\overset{O}{\overset{\|}{C}}-NH\right)_{n1}Y$$

wherein $n^1$ is an integer of 1 to 3, $R_4$ is defined supra; X and Y are monovalent radicals selected from Table 1 below:

TABLE I

| X | Y |
|---|---|
| $R_7-\overset{O}{\overset{\|}{C}}-NH-$ | $R_7-\overset{O}{\overset{\|}{C}}-NH-R_5-$ |
| 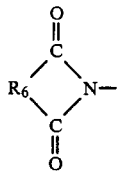 | 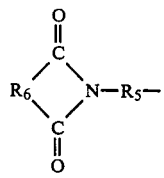 |

In Table 1, $R_5$ is defined supra, $R_8$ is the same as $R_3$ and defined supra, $R_6$ is selected from the groups sisting of arylene radicals of 6 to 16 carbon atoms and alkylene groups of 2 to 30 carbon atoms, and $R_7$ is selected from the group consisting of alkyl radicals having from 10 to 30 carbon atoms and aryl radicals having from 6 to 16 carbon atoms.

Mono- or polyurea compounds described by formula (4) above can be characterized as amides and imides of mono-, di-, and triureas. These materials are formed by reacting, in the selected proportions, suitable carboxylic acids or internal carboxylic anhydrides with a diisocyanate and a polyamine with or without a monoamine or monoisocyanate. The mono- or polyurea compounds are prepared by blending the several reactants together in a vessel and heating them to a temperature ranging from 70° F. to 400° F. for a period sufficient to cause formation of the compound, generally from 5 minutes to 1 hour. The reactants can be added all at once or sequentially.

The above mono- or polyureas can be mixtures of compounds having structures wherein n or $n^1$ varies from 0 to 8, or n or $n^1$ varies from 1 to 8, existent within the grease composition at the same time. For example, when a monoamine, a diisocyanate, and a diamine are all present within the reaction zone, as in the preparation of ureas having the structure shown in formula (2) above, some of the monoamine may react with both sides of the diisocyanate to form diurea (biurea). In addition to the formulation of diurea, simultaneous reactions can occur to form tri-, tetra-, penta-, hexa-, octa-, and higher polyureas.

Biurea (diurea) may be used as a thickener, but it is not as stable as polyurea and may shear and loose consistency when pumped. If desired, triurea can also be included with or used in lieu of polyurea or biurea.

Additives

In order to attain extreme pressure properties, antiwear qualities, and elastomeric compatibility, the additives in the additive package comprise tricalcium phosphate and calcium carbonate in the absence of oil soluble sulfur compounds. Advantageously, the use of both calcium carbonate and especially tricalcium phosphate in the additive package adsorbs oil in a manner similar to polyurea and, therefore, less polyurea thickener is required to achieve the desired grease consistency. Typically, the cost of tricalcium phosphate and calcium carbonate are much less than polyurea and, therefore, the grease can be formulated at lower costs.

Preferably, the tricalcium phosphate and the calcium carbonate are each present in the additive package in an amount ranging from 2% to 20% by weight of the grease. For ease of handling and manufacture, the tricalcium phosphate and calcium carbonate are each most preferably present in the additive package in an amount ranging from 3% to 10% by weight of the grease.

Desirably, the maximum particle sizes of the tricalcium phosphate and the calcium carbonate are 100 microns and the tricalcium phosphate and the calcium carbonate are of food-grade quality to minimize abrasive contaminants and promote homogenization. Calcium carbonate can be provided in dry solid form as $CaCO_3$. Tricalcium phosphate can be provided in dry solid form as $Ca_3(PO_4)_2$ or $3Ca_3(PO_4)_2.Ca(OH)_2$.

If desired, the calcium carbonate and/or tricalcium phosphate can be added, formed, or created in situ in the grease as byproducts of chemical reactions. For example, calcium carbonate can be produced by bubbling carbon dioxide through calcium hydroxide in the grease. Tricalcium phosphate can be produced by reacting phosphoric acid with calcium oxide or calcium hydroxide in the grease. Other methods for forming calcium carbonate and/or tricalcium phosphate can also be used.

The preferred phosphate additive is tricalcium phosphate for best results. While tricalcium phosphate is the preferred, other phosphate additives can be used, if desired, in conjunction with or in lieu of tricalcium phosphate, such as the phosphates of Group 2a alkaline earth metal, such as beryllium, magnesium, calcium, strontium, and barium, or the phosphates of a Group 1a alkali metal, such as lithium, sodium, and potassium.

Desirably, tricalcium phosphate is less expensive, less toxic, more readily available, safer, and more stable than other phosphates. Tricalcium phosphate is also superior to monocalcium phosphate and dicalcium phosphate. Tricalcium phosphate has unexpectedly been found to be compatible and noncorrosive with elastomers and seals of front-wheel drive joints. Tricalcium phosphate is also water insoluble and will not washout of the grease when contamination by water occurs. Monocalcium phosphate and dicalcium phosphate, however, were found to corrode, crack, and/or degrade some elastomers and seals of front-wheel drive joints. Monocalcium phosphate and dicalcium phosphate were also undesirably found to be water soluble and washout of the grease when the front-wheel drive joint was contacted with water, which significantly decreased the antiwear and extreme pressure qualities of the grease.

The preferred carbonate additive is calcium carbonate for best results. While calcium carbonate is preferred, other carbonate additives can be used, if desired, in conjunction with or in lieu of calcium carbonate, such as the carbonates of Group 2a alkaline earth metal, such as beryllium, magnesium, calcium, strontium, and barium.

Desirably, calcium carbonate is less expensive, less toxic, more readily available, safer, and more stable than other carbonates. Calcium carbonate is also superior to calcium bicarbonate. Calcium carbonate has been unexpectedly found to be compatible and noncorrosive with elastomers and seals of front-wheel drive joints and is water insoluble. Calcium bicarbonate, on the other hand, has been found to corrode, crack, and- /or degrade many of the elastomers and seals of front-wheel drive joints. Calcium bicarbonate has also been undesirably found to be water soluble and experiences many of the same problems as monocalcium phosphate and dicalcium phospate discussed above. Also, calcium bicarbonate is disadvantageous for another reason. During normal use, either the base oil or antioxidant additives will undergo a certain amount of oxidation. The end products of this oxidation are invariably acidic. These acid oxidation products can react with calcium bicarbonate to undesirably produce gaseous carbon dioxide. If the grease is used in a sealed application, such as a constant-velocity joint, the evolution of gaseous reaction products, such as carbon dioxides, could, in extreme cases, cause ballooning of the elastomeric seal. This would in turn place additional stress on the seal and seal clamps and could ultimately result in a seal failure and rupture. Calcium carbonate, however, is much more resistant to producing carbon dioxide, since its alkaline reserve is much higher than calcium bicarbonate.

The use of both tricalcium phosphate and calcium carbonate together in the additive package of the front-wheel drive grease was found to produce unexpected superior results in comparison to a similar grease with greater amounts by weight of: (a) tricalcium phosphate alone in the absence of calcium carbonate, or (b) calcium carbonate alone in the absence of tricalcium phosphate.

EXAMPLE 2

This test served as the control for subsequent tests. A base grease was formulated with about 15% by weight polyurea thickener and about 85% by weight paraffinic solvent extracted base oil. The polyurea thickener was prepared in a vessel in a manner similar to Example 1. The paraffinic solvent extracted base oil was mixed with the polyurea thickener until a homogeneous base grease was obtained. No additive package was added to the base grease. Neither tricalcium phosphate nor calcium carbonate were present in the base grease. The EP (extreme pressure)/antiwear properties of the base grease, comprising the last nonseizure load, weld load, and load wear index were measured using the Four Ball EP method as described in ASTM D2596. The results were as follows:

| | |
|---|---|
| Last nonseizure load, kg | 32 |
| Weld load, kg | 100 |
| Load wear index | 16.8 |

EXAMPLE 3

A front-wheel drive grease was prepared in a manner similar to Example 2, except that about 5% by weight of finely divided, precipitated tricalcium phosphate with an average mean diameter of less than 2 microns was added to the base grease. The resultant mixture was mixed and milled in a roll mill until a homogeneous grease was produced. The Four Ball EP Test showed that the EP/antiwear properties of the grease were significantly increased with tricalcium phosphate.

| | |
|---|---|
| Last nonseizure load, kg | 63 |
| Weld load, kg | 160 |

-continued

| | |
|---|---|
| Load wear index | 33.1 |

EXAMPLE 4

A front-wheel drive grease was prepared in a manner similar to Example 3, except that about 10% by weight tricalcium phosphate was added to the base grease. The Four Ball EP Test showed that the EP/antiwear properties were further increased with more tricalcium phosphate.

| | |
|---|---|
| Last nonseizure load, kg | 80 |
| Weld load, kg | 250 |
| Load wear index | 44.4 |

EXAMPLE 5

A front-wheel drive grease was prepared in a manner similar to Example 4, except that about 20% by weight tricalcium phosphate was added to the base grease. The Four Ball EP Test showed that the EP/antiwear properties of the grease were somewhat better than the 5% tricalcium phosphate grease of Example 3, but not as good as the 10% tricalcium phosphate grease of Example 4.

| | |
|---|---|
| Last nonseizure load, kg | 63 |
| Weld load, kg | 250 |
| Load wear index | 36.8 |

EXAMPLE 6

A front-wheel drive grease was prepared in a manner similar to Example 2, except that about 5% by weight of finely divided precipitated tricalcium phosphate and about 5% by weight of finely divided calcium carbonate were added to the base grease. The tricalcium phosphate and calcium carbonate had an average mean particle diameter less than 2 microns. The resultant grease was mixed and milled until it was homogeneous. The Four Ball EP Test showed that the EP/antiwear properties of the grease were surprisingly better than the base grease of Example 1 and the tricalcium phosphate greases of Examples 2–5.

| | |
|---|---|
| Last nonseizure load, kg | 80 |
| Weld load, kg | 400 |
| Load wear index | 52.9 |

EXAMPLE 7

A front-wheel drive grease was prepared in a manner similar to Example 6, except that 10% by weight tricalcium phosphate and 10% by weight calcium carbonate were added to the base grease. The Four Ball EP Test showed that the weld load was slightly lower and the load wear index were slightly better than the grease of Example 6.

| | |
|---|---|
| Last nonseizure load, kg | 80 |
| Weld load, kg | 315 |
| Load wear index | 55.7 |

EXAMPLE 8

A front-wheel drive grease was prepared in a manner similar to Example 7, except that 20% by weight tricalcium phosphate and 20% calcium carbonate were blended into the base grease The Four Ball EP Test showed that the EP/antiwear properties of the grease were better than greases of Examples 6 and 7.

| | |
|---|---|
| Last nonseizure load, kg | 100 |
| Weld load, kg | 500 |
| Load wear index | 85.6 |

EXAMPLE 9

A front-wheel drive grease was prepared in a manner similar to Example 2, except that about 10% by weight of finely divided calcium carbonate with a mean particle diameter less than 2 microns, was added to the base grease. The resultant grease was mixed and milled until it was homogeneous. The Four Ball EP Test showed that the weld load and load wear index of the calcium carbonate grease were better than the base grease of Example 2.

| | |
|---|---|
| Last nonseizure load, kg | 80 |
| Weld load, kg | 400 |
| Load wear index | 57 |

EXAMPLE 10

A front-wheel drive grease was prepared in a manner similar to Example 6, except that about 3% by weight tricalcium phosphate and about 5% by weight calcium carbonate were added to the base grease. The Four Ball EP Test showed that the weld load and load wear index of the grease were better than the greases of Example 4 (10% tricalcium phosphate alone) and Example 9 (10% calcium carbonate alone), even though the total combined level of additives was only 8%. This result is most surprising and unexpected. It illustrates how the two additives can work together to give the surprising improvements and beneficial results.

| | |
|---|---|
| Last nonseizure load, kg | 80 |
| Weld load, kg | 500 |
| Load wear index | 61.8 |

EXAMPLE 11

The front-wheel drive grease of Example 6 (5% by weight tricalcium phosphate and 5% by weight calcium carbonate) was subjected to the ASTM D4048 Copper Corrosion Test at a temperature of 300° F. for 24 hours. No significant corrosion appeared. The copper test sample remained bright and shiny. The grease was rated 1a.

EXAMPLE 12

The front-wheel drive grease of Example 10 (3% by weight tricalcium phosphate and about 5% by weight calcium carbonate) was subjected to the ASTM D4048 Copper Corrosion Test at a temperature of 300° F. for 24 hours. The results were similar to Example 11.

EXAMPLE 13

A front-wheel drive grease was prepared in a manner similar to Example 6, except that about 3.5% by weight tricalcium phosphate, about 3.5% by weight calcium carbonate, and about 7% by weight of an insoluble arylene sulfide polymer, manufactured by Phillips Petroleum Company under the trade name RYTON, were added to the base grease. The grease containing insoluble arylene sulfide polymer was subjected to the ASTM D4048 Copper Corrosion Test at a temperature of 300° F. for 24 hours and failed miserably. Significant corrosion appeared. The copper test strip was spotted and colored and was rated 3b.

EXAMPLE 14

A front-wheel drive grease was prepared in a manner similar to Example 3, except as follows. The base oil comprised about 60% by weight of 850 SUS paraffinic, solvent extracted, hydrogenated mineral oil, and about 40% by weight of 350 SUS paraffinic, solvent extracted, hydrogenated mineral oil. The base grease comprised 16.07% polyurea thickener. Instead of adding tricalcium phosphate, 11.13 grams of feed grade monocalcium phosphate and dicalcium phospate, sold under the brand name of Biofos by IMC, were added to the base grease. The resultant grease was milled in a manner similar to Example 2 and subjected to an Optimol SRV stepload test (described in Example 19). The test grease failed. The coefficient of friction slipped and was highly erratic, indicating rapid wear. The scar on the disk was rough and showed a lot of wear.

EXAMPLE 15

The grease of Example 13 containing oil-insoluble arylene polymers was subjected to the ASTM D4170 Fretting Wear Test and an Elastomer Compatibility Test for Silicone at 150° C. for 312 hours. The results were as follows:

| | |
|---|---|
| Fretting Wear, ASTM D4170, 72 hr mg loss/race set | 5.6 |
| Elastomer Compatibility with Silicone | |
| % loss tensile strength | 17.4 |
| % loss total elongation | 16.9 |

EXAMPLE 16

The front wheel drive grease of Example 6 was subjected to the ASTM D4170 Fretting Wear Test and an Elastomer Compatibility Test for Silicone at 150° C. for 312 hours. The grease displayed substantially better fretting resistance and elastomer compatibility than the grease of Example 15 containing insoluble arylene polymers.

| | |
|---|---|
| Fretting Wear, ASTM D4170, 72 hr mg loss/race set | 3.0 |
| Elastomer Compatibility with Silicone | |
| % loss tensile strength | 9.9 |
| % loss total elongation | 12.2 |

EXAMPLE 17

A front-wheel drive grease was prepared in a manner similar to Example 6, except as described below. The polyurea thickener was prepared in a manner similar to Example 1 by reacting 676.28 grams of a fatty amine, sold under the brand name Armeen T by Armak Industries Chemicals Division, 594.92 grams of a diisocyanate, sold under the brand name Mondur CD by Mobay Chemical Corporation, and 536 ml of water. The base oil had a viscoscity of 650 SUS at 100° F. and was a mixture of 850 SUS paraffinic, solvent extracted, hydrogenated mineral oil, and hydrogenated solvent extracted, dewaxed, mineral oil. Corrosive inhibiting agents, sold under the brand names of Nasul BSN by R. T. Vanderbilt Co. and Lubrizol 5391 by the Lubrizol Corp., were added to the grease for ferrous corrosion protection. The anti-oxidants were a mixture of arylamines. The grease was stirred and subsequently milled through a Gaulin Homogenizer at a pressure of 7000 psi until a homogeneous grease was produced. The grease had the following composition:

| Component | % (wt) |
|---|---|
| 850 SUS Oil | 47.58 |
| 350 SUS Oil | 31.20 |
| Polyurea Thickener | 9.50 |
| Tricalcium Phosphate | 5.00 |
| Calcium Carbonate | 5.00 |
| Nasul BSN | 1.00 |

| Component | % (wt) |
|---|---|
| Lubrizol 5391 | 0.50 |
| Mixed Aryl Amines | 0.20 |
| Dye | 0.02 |

The grease was tested and had the following performance properties:

| | |
|---|---|
| Work Penetration, ASTM D217 | 307 |
| Dropping Point, ASTM D2265 | 501° F. |
| Four Ball Wear, ASTM D2266 at 40 kg, 1200 rpm for 1 hr | 0.50 |
| Four Ball EP, ASTM D2596 | |
| last nonseizure load, kg | 80 |
| weld load, kg | 400 |
| load wear index | 57 |
| Timken, ASTM D4170, lbs | 60 |
| Fretting Wear, ASTM D4170, 24 hr mg loss/race set | 0.8 |
| Corrosion Prevention Test, ASTM D1743 | 1 |
| Elastomer Compatibility with Polyester | |
| % loss tensile strength | 21.8 |
| % loss maximum elongation | 12.9 |
| Elastomer Compatibility with Silicone | |
| % loss tensile strength | 7.4 |
| % loss maximum elongation | 24.2 |

EXAMPLE 18

The grease of Example 17 was subjected to an oil separation cone test (bleed test), SDM 433 standard test of the Saginaw Steering Gear Division of General Motors. In the test,the grease was placed on a 60 mesh nickel screen cone. The cone was heated in an oven for the indicated time at the listed temperature. The percentage decrease in the weight of the grease was measured. The test showed that the minimum oil loss ocurred even at higher temperatures over a 24-hour time period. The results were as follows:

| time (hr) | temp (°F.) | % oil loss |
|---|---|---|
| 6 | 212 | 1.9 |
| 24 | 212 | 4.4 |
| 24 | 300 | 2.1 |
| 24 | 350 | 3.4 |

EXAMPLE 19

The grease of Example 17 was subjected to an Optimol SRV stepload test under conditions recommended by Optimol Lubricants, Inc. and used by Automotive Manufacturers such as General Motors for lubricant evaluation. This method was also specified by the U.S. Air Force Laboratories Test Procedure of March 6, 1985. In the test, a 10 mm steel ball is oscillated under load increments of 100 newtons on a lapped steel disc lubricated with the grease being tested until seizure occurs. The grease passed the maximum load of 900 newtons.

The subject polyurea thickened greases with tricalcium phosphate and calcium carbonate provide unexpected, surprisingly good results which are superior to prior greases. Blending, mixing, and combining tricalcium phosphate and calcium carbonate in polyurea thickened greases, as was invented by the applicant, provide a synergistic combination and result which increase the level of extreme pressure performance with less additives (i.e. $A+B > 2A$ or $2B$). This is described in Example 10. This is particularly important to reduce the cost and milling time of the grease. Significantly, the synergistic combination of tricalcium phosphate and calcium carbonate in the subject polyurea thickened grease also improves the performance of front-wheel drive vehicles, which are often subject to extreme pressures and temperatures over 300° F. It also provides excellent wear resistance to fretting, rotation, linear motion and shock loading, as well as has good oil separation properties and resistance to corrosion.

Sulfurized materials are corrosive to ferrous and nonferrous materials at higher temperatures, such as 300° F. Since the subject front-wheel drive grease must be used at such temperatures, superior performance at those temperatures is an absolute necessity. Also, sulfurized materials, whether they be oil soluble or oil insoluble, as with arylene sulfide polymers, increase the chemical incompatibility of the resulting grease with constant velocity joint boot elastomers. Indeed, the oil soluble sulfurized materials as used by Clarke et al. U.S. Pat. No. 4,107,058 will typically destroy the elastomers entirely when temperatures exceed from 250° F. to 300° F. The detrimental effect of arylene sulfide polymers on elastomer compatibility has been demonstrated by the applicant. (See Examples 11–13, and 15–16.) Furthermore, for many years the largest U. S. car manufacturer in its commercial operations has refrained from using constant-velocity joint greases which contained sulfur containing additives, such as oil soluble sulfurized materials such as those required by Clarke et al. U.S. Pat. No. 4,107,058. Therefore, the superior performance of the subject grease over greases containing any sulfurized additives is a highly significant advance in the state of the art.

The use of the subject grease having a mixture of calcium carbonate and tricalcium phosphate having all the previously described performance advantages is neither obvious nor apparent from Piotrowski et al., U.S. Pat. No. 4,440,658 and Clarke et al., U.S. Pat. No. 4,107,058. Certainly, it is not obvious to skilled artisans in the grease art at Amoco and General Motors, who collectively have hundreds of years of experience in the grease art.

The described properties of the tricalcium phosphate/calcium carbonate system in the subject front-wheel drive grease is of utmost importance in commerical applications. Significantly, the ability of tricalcium phosphate and calcium carbonate to provide in combination EP/antiwear performance greater than larger amounts of either additive alone allows higher levels of performance to be more easily attained. Furthermore, since less total additives are required when used in combination, the cost of the grease is reduced.

Moreover, since less total additives of tricalcium phosphate and calcium carbonate are required when used in combination in the subject grease, less solids will have to be milled into the grease to attain a desired level of performance. This effect is important since rigorous milling is required to mill the solids into the grease and achieve a smooth, nongritty product. Ordinarily, several passes through a grease mill are required to achieve the necessary smooth texture. The number of passes required rises significantly as total solid additive levels increase. Any effect which can reduce the total solid additives level without adversely affecting performance (EP/antiwear) will reduce the required milling. This will in turn significantly reduce the manufacturing time and cost. Therefore, the ability of the tricalcium phosphate/calcium carbonate additive package in the subject grease to give superior performance at reduced total additive levels is also an important advance in lubricating grease performance technology.

Applicant's inventive grease is a small but important contribution in the crowded grease art. Applicant's grease achieves novel synergistic results. It is now commercially very successful. The extreme pressure tests showed unexpected surprisingly good results which make the subject grease a superior front-wheel drive grease.

Among the many advantages of the novel front-wheel drive grease are:

1. High performance on front-wheel drive joints
2. Superior fretting wear protection
3 Excellent oil separation qualities, even at high temperatures.
4. Remarkable compatibility and protection of elastomers and seals of front-wheel drive joints
5. Greater stability at high temperatures for long periods of time
6. Nontoxic
7. Safe
8. Economical Although embodiments of this invention have been described, it is to be understood that various modifications and substitutions can be made by those skilled in the art without departing from the novel spirit and scope of this invention.

What is claimed is:

1. A lubricating grease, comprising:

a substantial proportion of a base oil;

a thickener comprising a member selected from the group consisting of biurea, triurea, and polyurea; and a combined carbonate and phosphate additive package comprising both a carbonate and a phosphate in the absence of insoluble arylene sulfide polymers and oil soluble sulfur-containing compounds, said carbonate selected from the group consisting of a carbonate of a Group 1a alkali metal and a carbonate of a Group 2a alkaline earth metal and said phosphate selected from the group consisting of a phosphate of a Group 1a alkali metal and a phosphate of a Group 2a alkaline earth metal;

said carbonate interacting with said phosphate in the absence of sulfur-containing compounds for enhancing the performance of said grease;

said alakaline earth metal being selected from the group consisting of beryllium, magnesium, calcium, strontium, and barium; and said alkali metal being selected from the group consisting of lithium, sodium, potassium, rubidium, cesium, and francium.

2. A lubricating grease in accordance with claim 1 wherein said carbonate comprises calcium carbonate and said phosphate comprises tricalcium phosphate.

3. A lubricating grease, comprising:

at least 70% by weight base oil;

from about 7% to about 12% by weight polyurea thickener; and an extreme pressure wear-resistant mixture providing an additive package, said additive package consisting essentially of tricalcium phosphate and calcium carbonate in the absence of sulfur-containing compounds and arylene sulfide polymers, said tricalcium phosphate and said calcium carbonate interacting with each other to enhance the extreme pressure wear-resistant properties of said grease;

said tricalcium phosphate being present in an amount ranging from about 3% to about 10% by weight of said grease; and said calcium carbonate being present in an amount ranging from about 3% to about 10% by weight of said grease.

4. A lubricating grease in accordance with claim 3 wherein said base oil comprises a member selected from the group consisting of naphthenic oil, paraffinic oil, aromatice oil, and a synthetic oil, said synthetic oil comprising a member selected from the group consisting of a polyalphaolefin, a polyester, and a diester, polyalkyl ethers, polyaryl ethers, silicone polymer fluids, and combinations thereof.

5. A lubricating grease in accordance with claim 3 wherein said base oil comprises a mixture of two different refined, solvent-extracted, hydrogenated, dewaxed base oils.

6. A lubricating grease in accordance with claim 5 wherein said base oil comprises about 60% by weight of a 850 SUS refined solvent-extracted hydrogenated dewaxed base oil and about 40% by weight of a 350 SUS refined solvent-extracted hydrogenated dewaxed base oil.

* * * * *

UNITED STATES PATENT OFFICE
CERTIFICATE OF CORRECTION

Patent No. 4,830,767 Dated May 16, 1989

Inventor(s) John A. Waynick

It is certified that error appears in the above-identified patent and that said Letters Patent is hereby corrected as shown below:

| Column | Line | |
|---|---|---|
| 4 | 45-46 | "sesquiterpense" should read --sesquiterpenes-- |
| 4 | 46 | "diterpense" should read --diterpenes-- |
| 4 | 46-47 | "terpenses" should read --terpenes-- |
| 5 | 46 | "methol 2-" should read --methol-2- -- |
| 9 | 21 | "sisting" should read --consisting-- |
| 18 | 47 | "aromatice" should read --aromatic-- |

Signed and Sealed this

Tenth Day of July, 1990

*Attest:*

HARRY F. MANBECK, JR.

*Attesting Officer*

*Commissioner of Patents and Trademarks*